United States Patent [19]

Iten

[11] Patent Number: 4,599,793

[45] Date of Patent: Jul. 15, 1986

[54] RAZOR CONNECTOR

[75] Inventor: Clemens A. Iten, Staunton, Va.

[73] Assignee: American Safety Razor Company, Verona, Va.

[21] Appl. No.: 614,237

[22] Filed: May 23, 1984

[51] Int. Cl.[4] ..... B26B 21/00

[52] U.S. Cl. ..... 30/47; 30/89; 30/85

[58] Field of Search ..... 30/85, 89, 47, 50, 87, 30/57

[56] References Cited

U.S. PATENT DOCUMENTS

| | | | |
|---|---|---|---|
| 1,235,040 | 7/1917 | McCain | 30/85 X |
| 1,817,925 | 8/1931 | Marcy | 30/89 X |
| 2,911,711 | 11/1959 | Loughlin . | |
| 3,785,051 | 1/1974 | Dawidowicz . | |
| 3,797,657 | 3/1974 | Petrillo . | |
| 4,163,316 | 8/1979 | Hagmann . | |
| 4,226,459 | 10/1980 | Natalicio . | |
| 4,282,650 | 8/1981 | Trotta . | |
| 4,392,303 | 7/1983 | Ciaffone . | |
| 4,422,237 | 12/1983 | Trotta . | |
| 4,446,619 | 5/1984 | Jacobson . | |

FOREIGN PATENT DOCUMENTS

| | | | |
|---|---|---|---|
| 2064408 | 6/1981 | United Kingdom | 30/85 |

*Primary Examiner*—E. R. Kazenske
*Assistant Examiner*—Willmon Fridie, Jr.
*Attorney, Agent, or Firm*—Wender Murase & White

[57] ABSTRACT

The invention discloses a razor connector for affixing a razor handle (10) to a razor head (12) having a base (16) disposed on the razor handle. A pair of opposed upstanding spaced members (20) are attached to the base between the base ends and each member has a flange (24) for engagement with a bar (40) of the razor head. The connector also has a pair of outriggers (36) attached to each end of the base (16) and one outrigger is on each side of the opposed upstanding members (20). The connector also incorporates means for biasing the base (16) in a beam-like fashion so as to increase the gap between opposed upstanding members (20) distal the base, which allows release of the connection between the flanges (24) and the bar (40). The means for biasing the base can be a second pair of upstanding members (46), which are squeezed in an inwardly direction.

8 Claims, 5 Drawing Figures

Fig. 3
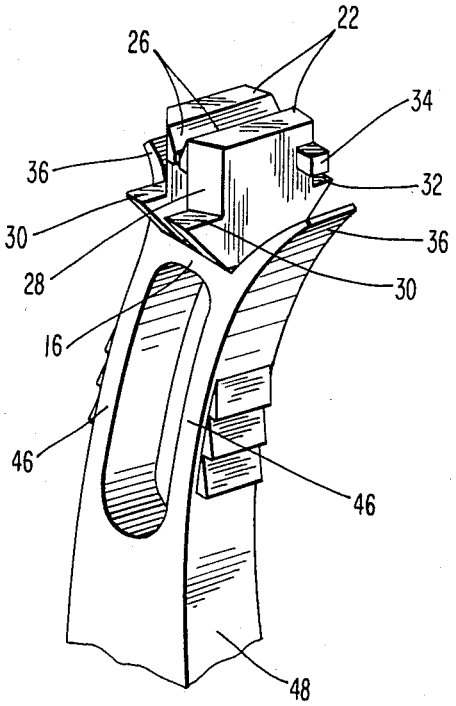
Fig. 4
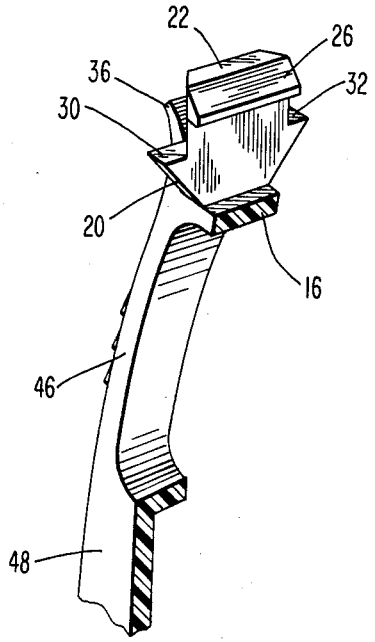
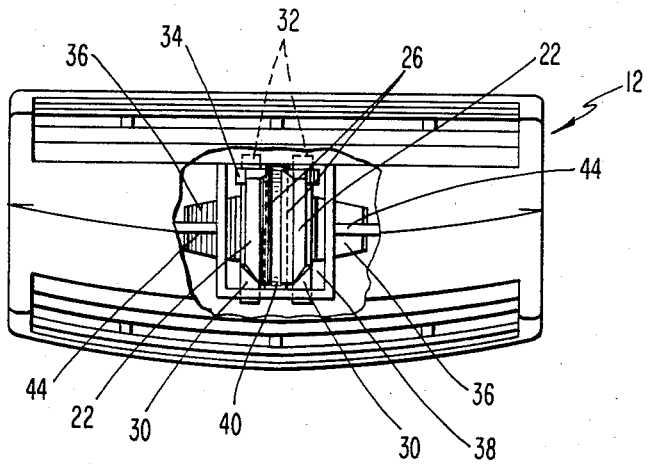
Fig. 5

RAZOR CONNECTOR

BACKGROUND OF THE INVENTION

The present invention relates generally to razors and more particularly to a connector for selective attachment of a razor handle to a razor head.

SUMMARY OF THE INVENTION

Contemporary razors are often designed with handles that may be selectively attached to razor head cartridges. The cartridges are disposable and usually have a multiple-piece plastic casing that encaptures one or more razor blades. The cartridges are selectively removable from the razor handle, often by means of a T-shaped female channel defined by the cartridge and a corresponding T-shaped male member on the handle adapted to be inserted into the cartridge channel by a sliding movement. Such a construction is shown, for instance, in U.S. Pat. No. 3,785,051, issued Jan. 15, 1974.

Cartridges having a T-shaped channel are designed to mate tightly with the razor handle male member, and thus require a relatively large amount of force in order to effect a union between the two components. The dispensers generally utilized to hold T-shaped channel cartridges usually incorporate guide means, therein in order to ensure proper mating alignment between the cartridge and handle during the union thereof. The requirements of precise alignment between the cartridge and handle and relatively strong pressure needed to join the components can be inconvenient to a user who is ill or that might have wet hands, such as in a shower.

It is an object of the present invention to create a razor connector that allows a razor handle to be utilized with a multitude of replacement cartridges.

It is another object of the present invention to create a razor connector that does not require precision construction tolerances of connector components.

It is another object of the present invention to design a razor connector that does not require precise alignment between connector components on the razor head and handle or great strength in order to effect connection thereof.

The present invention features a razor connector having snap-in, plug-like connection of a razor handle to a razor head cartridge. By having snap-in connection construction, alignment between the handle and head components is easily effected with minimal strength. The razor connector of the present invention affixes a razor head, which can be a disposable cartridge, to a razor handle. The connector has a base, having ends disposed on a razor handle. The razor handle also has a pair of opposed, upstanding members attached to the base between the base ends.

Each upstanding member has a flange for engagement with a razor head; the flanges are oriented so that they are directed toward the opposite opposed member. The connector also has a pair of upward extension outriggers. One of each outrigger is attached to each end of the base so that the upstanding members are therebetween. There is also a means for biasing the base in a beam-like fashion, so that the opposed space between the members distal the base portion increases as the means for biasing is engaged. The razor head defines a cavity on an outer surface thereof, that is adapted for receipt of the upstanding members. If desired, the cavity and upstanding members can be so dimensioned so as to allow insertion therebetween in only a single orientation. A bar is also attached to the razor head transverse the cavity and is adapted for engagement with the flanges of the upstanding members when they are inserted into the cavity.

The features of the present invention allow simple snap-in, plug-like connection of a razor handle to a razor head with minimal strength and alignment precision. The snapping connection is effected by the opposed flanges on each upstanding member engaging over the razor head bar, to prevent axial separation of the razor head and handle once the two components are snapped together.

When separation of the components of the razor head and handle is desired, engagement of the means for biasing the base bends the base in a beam-like fashion, which in turn spreads the distal ends of the opposed upstanding members and thus allows the flanges to disengage from contact with the razor head bar. The outriggers help to stabilize the razor head relative to the handle once the two components are attached and also may advantageously bias the head and handle relative each other, to ensure tight engagement between the flanges and the razor head bar. Outrigger biasing eliminates the need to have precise construction tolerances between the upstanding members, the razor head cavity and the razor head bar.

BRIEF DESCRIPTION OF THE DRAWINGS

A better understanding of the invention may be had by reference to the accompanying drawings, which form part of the present disclosure in which:

FIG. 3 is a front-elevational perspective view of the razor handle portion of the connector;

FIG. 4 is an elevational-sectional view, shown in perspective, taken along 4—4 of FIG. 1;

FIG. 5 is a partial sectional view taken along 5—5 of FIG. 1.

DESCRIPTION OF THE PREFERRED EMBODIMENTS

Figure 1:
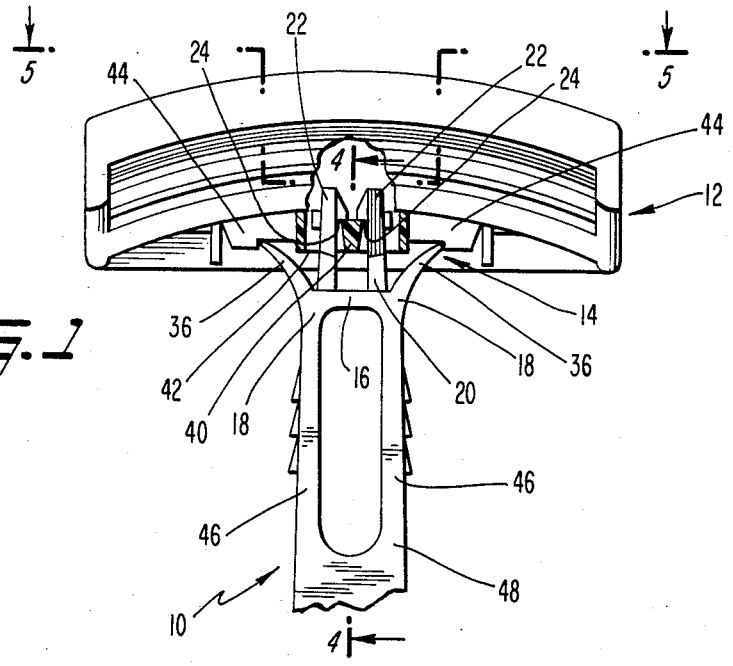
FIG. 1 is a front elevational view of a razor head and handle constructed in accordance with the present invention and showing the connector portion thereof in partial section, a portion of the razor handle and razor head being broken away.

Referring to the drawings, FIG. 1 shows a razor handle 10 attached to a razor head 12 by a razor connector, generally indicated as 14. The razor handle has a base portion 16 having ends 18.

A pair of opposed upstanding spaced members 20 are attached to the base 16 between the base ends 18. As is shown in FIG. 1 and the phantom position of FIG. 2, the upstanding members 20 are inclined so that the distal ends 22 thereof, are spaced closer together than the ends proximate the base 16. The distal ends 22 include inwardly-directed flanges 24 that face the other opposed upstanding member 20.

Further structural features of the upstanding members are shown in greater detail in FIGS. 3 and 4. Each upstanding member has beveled end portions 26 and beveled front portions 28. The upstanding members 20 also define paired front stops 30 and paired rear stops 32. The outer sidewalls of each upstanding member closest to the base ends 18 also define thrust surfaces or nibs 34. The razor connector also incorporates upward extensions or outriggers 36, one of each outrigger being attached to each base 18 with the opposed upstanding members 20 therebetween.

The female portion of the razor connector is incorporated in the razor head and is best understood by reference to FIGS. 1 and 5. The razor incorporates a cavity 38 on the lower surface of its outer face adapted for receipt of the opposed upstanding members 20. The razor head also incorporates a bar 40 that transverses the cavity 38, adapted for passage between the upstanding members 20 when they are inserted in the cavity as shown in FIG. 1. The bar 40 has a tapered cross-sectional profile wherein the smallest portion of the taper is proximate the outer surface of the razor head. The razor head also defines a cavity platform 42 on the outer surface thereof proximate the cavity 38 and platform webs 44.

If desired, the cavity 38 and upstanding members 20 can be configured so as to allow joinder of the razor connector portions in only one orientation. As shown in FIG. 5, the cavity 38 is constructed in a modified hexagonal configuration, which mates with the configuration of the upstanding members 20 shown in FIGS. 3 and 4. For instance, the narrow, generally tapered side portion of the cavity 38 mates with the beveled front portions 28 of the upstanding members 20.

The selectively releasable snap-in features of the razor connector 14 will be explained with reference to FIGS. 1, 2 and 5. Referring to FIG. 1, the male portion of the razor connector is shown inserted into the female portion of the connector. Connection is accomplished by insertion of the upstanding members 20 into the razor head cavity 38, one of each of the members straddling the razor head bar 40.

During insertion of the handle portion of the connector into the razor head portion of the connector, the upstanding members 20 are biased in an outwardly direction, i.e., toward each respective outrigger 36. The outwardly directed biasing is facilitated by the beveled end portions 26 on each upstanding member 20, which together form a V-shaped notch therebetween. As a further aid to outwardly directed-biasing during insertion of the handle 10 into the razor head 12, the razor bar 40 is preferably tapered, as shown in FIGS. 1 and 2, so that the bar acts a wedge being driven between the V-shaped groove defined by the beveled ends 26. The V-shaped groove acts as an insertion guide, which facilitates joinder of the razor connector portions 14 without the need for precise alignment by the razor user. Thus, insertion is easily accomplished, such as in the insertion of a electrical plug into a wall recepticle.

Once the upstanding members 20 are inserted into the cavity 38, the flanged portions 24 clear the top of the bar 40 and snap back into their unbiased, inwardly directed inclination. The flanges 24 override the top of the bar 40 and prevent axial separation of the razor head 12 from the razor handle 10.

The connector 14 is also provided with means to limit insertion of the razor handle 10 into the razor head 12 in the form of the paired front stops 30, the paired rear stops 32 and the outriggers 36. As the upstanding members 20 are inserted into cavity 38, the outriggers 36 will contact the razor platform webs 44; continued insertion of the razor handle 10 into razor head 12 will bias the outriggers in a cantiliver-like fashion, which will resist further insertion of the razor handle. If further insertion is continued, front stops 30 and rear stops 32 will contact cavity platform 42, thus preventing further insertion.

The razor connector 14 also has features to ensure stability of the connection between razor handle 10 and razor head 12. The outriggers 36 and platform webs 44 help to resist rocking of the razor handle 10 relative razor head 12 in the clockwise and counterclockwise rotational directions as shown in FIG. 1. The cantilever-like biasing of the outriggers 36, also maintains relatively tight contact between the upstanding member flanges 24 and razor head bar 40, which helps to prevent inadvertent release of the connection therebetween.

The combination of the upstanding members 20 and outriggers 36 of the razor handle 10 and the mating cavity 38 and webs 44 on the razor head 12 provide structural triangulation to resist rocking side-to-side motion of the handle relative to the razor head. The front stops 30 and rear stops 32 tend to prevent front-to-back rocking motion of the razor head 12 relative handle 10, i.e., relative motion that would be in the direction in and out of the drawing FIG. 1. The nibs or thrust surfaces 34 resist torsional motion of the razor handle 10 relative the razor head 12, i.e., clockwise or counterclockwise relative motion as would appear in FIG. 5.

Figure 2:
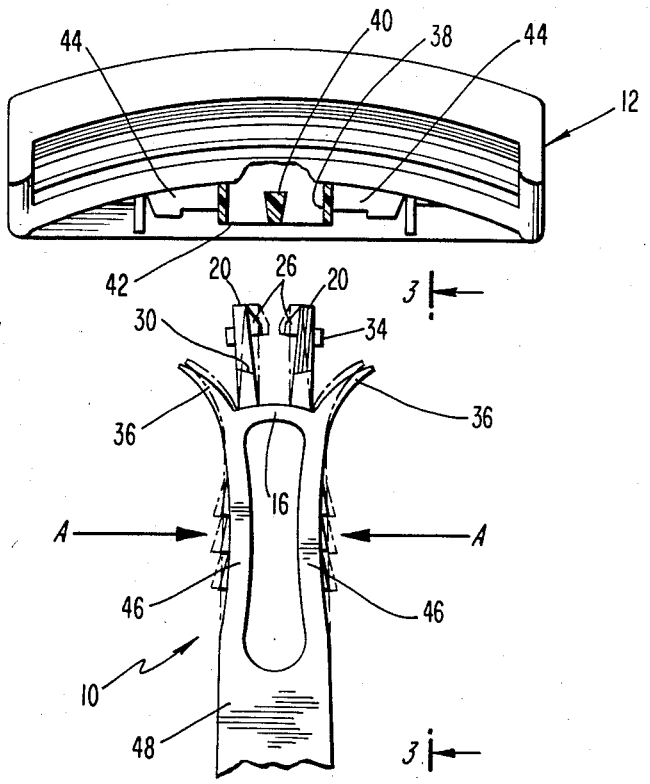
FIG. 2 is a exploded view of FIG. 1 showing the razor head being separated from the razor handle by biasing a portion of the razor handle shown by the arrows labelled A—A.

It is a desirable feature of the present invention to have means for selectively releasing razor connector 14, so that the razor head 12 may be removed fron razor handle 10, and the function thereof is more fully shown in FIG. 2. When desired release of the connector 14 is to be accomplished, the upstanding members 20 are biased in an outwardly direction i.e., toward the outriggers, so that the distal ends, including the flanges 24 thereof, clear razor head bar 40 and thus allow relative axial separation of the razor handle 10 and head 12. In a preferred embodiment of the invention, the distal ends of upstanding members 20 are spread by biasing or bowing base 16 in a beam-like fashion so that the base ends 18 are rotated in a downwardly direction, as apparent in the solid line representation shown in FIG. 2.

The preferred means for biasing the base 16 is by a second pair of upstanding members 46 attached to the base ends 18 and in turn to the remaining portion 48 of the handle 10. Pressing inwardly on the second pair of upstanding members 46, as shown by the arrows notated "A" creates a torsional beam-bending motion in the base 16, which in turn spreads the upstanding members 20. Such beam-like bending motion is also described U.S. Pat. No. 4,226,459, issued Oct. 7, 1980 and entitled "Gelatin Capsule Holder" the relevant portions of which are incorporated herein by reference.

Other means for biasing the upstanding members 20 in an outwardly direction, in order to release the connection thereof with bar 40 are also contemplated. As a further example, each upstanding member could be pivoted and spring loaded, such as shown and described in U.S. Pat. No. 3,797,657 entitled "Package", issued Mar. 19, 1974, most particularly FIGS. 4 and 5 and the relevant descriptive text portions thereof, which are hereby incorporated by reference.

Inasmuch as the present invention is subject to many variations, modifications and changes in detail, it is intended that all matter contained in the foregoing description or showing in the accompanying drawings shall be interpretated as illustrative and not in a limiting sense.

What is claimed is:

1. A razor connector for connecting a razor head to a razor handle, comprising:

a base;

a first pair of upstanding members attached to said base and having opposed vertical interior faces defining a centrally-disposed vertical gap therebetween;

a pair of flanges, one attached to each of said opposed vertical interior faces adjacent a top of each face to project toward each other into said gap;

a cavity in an outer surface of said razor head, for receiving at least a top portion of said first pair of upstanding members;

a bar attached to said razor head across said cavity for protruding into said gap and being secured by said pair of flanges when said first pair of upstanding members is at least partially inserted into said cavity; and a second pair of upstanding members, connecting said base to said handle, for selectably applying a bending force to said base, and so for selectably increasing a distance between said flanges to cause said flanges to release said bar when said first pair of upstanding members is in said cavity.

2. The connector as recited in claim 1 wherein said razor head bar has a tapered cross-sectional profile, the smallest width of said taper being proximate said outer surface.

3. The connector as recited in claim 1 wherein said flanges respectively comprise ends of said first pair of upstanding members distal said base, said member ends being beveled, in mutually opposed relationship, said beveled member ends defining a generally V-shaped notch adapted for receipt of said bar therebetween.

4. The connector as recited in claim 1 wherein said first pair of upstanding members has sidewalls defining thrust surfaces.

5. The connector as recited in claim 1 wherein said first pair of upstanding members define ledges proximate said base so as to limit insertion of said first pair of upstanding members into said razor head cavity.

6. The connector as recited in claim 5 wherein razor head outer surface defines a platform proximate said cavity for contact with said ledges on first pair of upstanding members when said first pair of upstanding members is fully inserted into said razor head cavity.

7. The connector as recited in claim 6 wherein each of said second pair of upstanding members further comprises an upward extension outside of and together bracketting at least a bottom portion of said first pair of upstanding members, and wherein razor head outer surface defines webs, projecting therefrom, proximate said platform for contact with said upward extensions during insertion of said first pair of upstanding members into said razor head cavity.

8. The connector as recited in claim 1 wherein said first pair of upstanding members and said cavity define corresponding polygonal shapes so as to allow alignment and relative receipt therebetween in only one relative orientation.

* * * * *